US007752718B2

(12) United States Patent
Fisher et al.

(10) Patent No.: US 7,752,718 B2
(45) Date of Patent: Jul. 13, 2010

(54) SNAP FASTENER

(75) Inventors: Josh Fisher, Sioux Falls, SD (US); R. Todd Brua, Sioux Falls, SD (US)

(73) Assignee: ORC Industries, LaCrosse, WI (US)

( * ) Notice: Subject to any disclaimer, the term of this patent is extended or adjusted under 35 U.S.C. 154(b) by 871 days.

(21) Appl. No.: 11/352,554

(22) Filed: Feb. 13, 2006

(65) Prior Publication Data

US 2007/0084023 A1 Apr. 19, 2007

Related U.S. Application Data

(60) Provisional application No. 60/727,069, filed on Oct. 14, 2005.

(51) Int. Cl.
*A44B 1/34* (2006.01)
*A44B 1/28* (2006.01)

(52) U.S. Cl. ..... 24/114.4

(58) Field of Classification Search ..... 24/90.1, 24/94, 103, 104, 114.6, 114.4, 114.12, 114.05, 24/662, 692, 693

See application file for complete search history.

(56) References Cited

U.S. PATENT DOCUMENTS 3,812,809 A * 5/1974 Salmon ..... 114/114
4,982,480 A * 1/1991 Kasai ..... 24/586.11
5,103,538 A * 4/1992 Ryder ..... 24/662
5,575,043 A * 11/1996 Candotti ..... 24/114.4
6,006,406 A * 12/1999 Chung ..... 24/713.6
6,099,527 A * 8/2000 Hochschuler et al. ..... 606/279
6,442,808 B2 * 9/2002 Fildan et al. ..... 24/689
6,497,034 B2 * 12/2002 Chung ..... 29/509
6,757,945 B2 * 7/2004 Shibuya et al. ..... 24/662
7,013,539 B2 * 3/2006 Fildan et al. ..... 24/693

OTHER PUBLICATIONS

Photographs of snap fastener, undated, 5 pages.

* cited by examiner

*Primary Examiner*—Robert J Sandy
(74) *Attorney, Agent, or Firm*—Patterson, Thuente, Christensen, Pedersen P.A.

(57) ABSTRACT

A molded polymer snap fastener, including a first portion having a plurality of first barbs extending outwardly therefrom, the first barbs each having a first radius R1 and the second portion having a plurality of second barbs extending outwardly therefrom, the second barbs having a second radius R2. The first barbs are arranged along a first substantially circular line, the first substantially circular line having a third radius R3. The second barbs are arranged along a second substantially circular line, the second substantially circular line having a fourth radius R4. The third radius R3 is different from the fourth radius R4 and the second barbs and the first barbs are arranged such that the second barbs fall into spaces between the first barbs when the first portion and the second portion are mated.

18 Claims, 11 Drawing Sheets

SECTION 7-7

SECTION 8-8

SNAP FASTENER

CLAIM TO PRIORITY

This application claims the benefit of U.S. Provisional Application No. 60/727,069, filed Oct. 14, 2005 entitled "SNAP FASTENER."

FIELD OF THE INVENTION

The invention generally relates to snap fastener for fastening clothing and the like. More particularly the invention relates to polymer snap fasteners.

BACKGROUND OF THE INVENTION

Snap fasteners have existed for decades. Existing snap fasteners have primarily been formed from stamped metal. Stamped metal snap fasteners are somewhat complex to manufacture as each of the two halves of the snap fastener is formed from several parts that must be joined together.

Snap fasteners generally have a male portion and female portion. For the purposes of this application the male and female portions will refer the to the two halves of the snap fastener as they are joined together with fabric or another substrate in between to make permanent attachment to fabric or other material. Thus, the male portion has an extending portion that is used to pierce or pass through the fabric to mate with the female portion which has an opening therein to receive the extending portion of the male portion.

Snap fasteners formed from polymers or plastics also exist. Polymers snap fasteners are generally formed by an injection molding process. Currently plastic snap fasteners may not create a sufficient retention force in their attachment to fabrics and like materials.

Thus, the snap fastener and textile industries would benefit from a polymer snap fastener which has improved retention characteristics when used as a closure and which forms a strong attachment to fabric that it is joined to.

SUMMARY OF THE INVENTION

The snap fastener of the present invention generally includes a male portion and female portion. The male portion and female portion are joinable to one another via a rivet attached to the male portion which may be passed through a textile item or other material before joining the male portion to the female portion for attachment to the fabric. Thus, each snap has both a male portion and a female portion when assembled. This arrangement has the advantage of presenting a snap that can be closed two different ways, either from the front or from the rear.

The snap fastener of the present invention also has strategically placed barbs on the back surface of both the male portion and the female portion in order to maximize gripping of the textile material or other material to which the snap is attached. The barbs are placed in such a way that the barbs on the male portion and the barbs on the female portion do not interfere with one another yet interlock when assembled. The snap fastener of the present invention is also formed so that the male portion has on its back surface a raised ridge around the rim of the male portion. This allows the male portion to have a lowered profile when attached to the female portion thus providing a snap that is less bulky.

Barbs of the female portion and barbs of the male portion are arranged to interlock with each other. Barbs of the female portion and barbs of the male portion are arranged on concentric circles of slightly different sizes substantially concentrically located. Barbs of the female portion are interposed between barbs of the male portion without interference between the barbs. Barbs of the female portion have a radius R1 and barbs of the male portion have a radius R2. Barbs may also have a perimeter shape that is other than circular in which case R1 and R2 will reflect the radii of circles that enclose the perimeters of barbs. The inner circle on which the barbs are located has a radius R3. The outer circle on which the barbs are located has a radius R4. The absolute value of the difference between radius R3 and radius R4 preferably may be less than about the absolute value of the sum of radii R1 and R2.

DETAILED DESCRIPTION OF THE INVENTION

Figure 1:
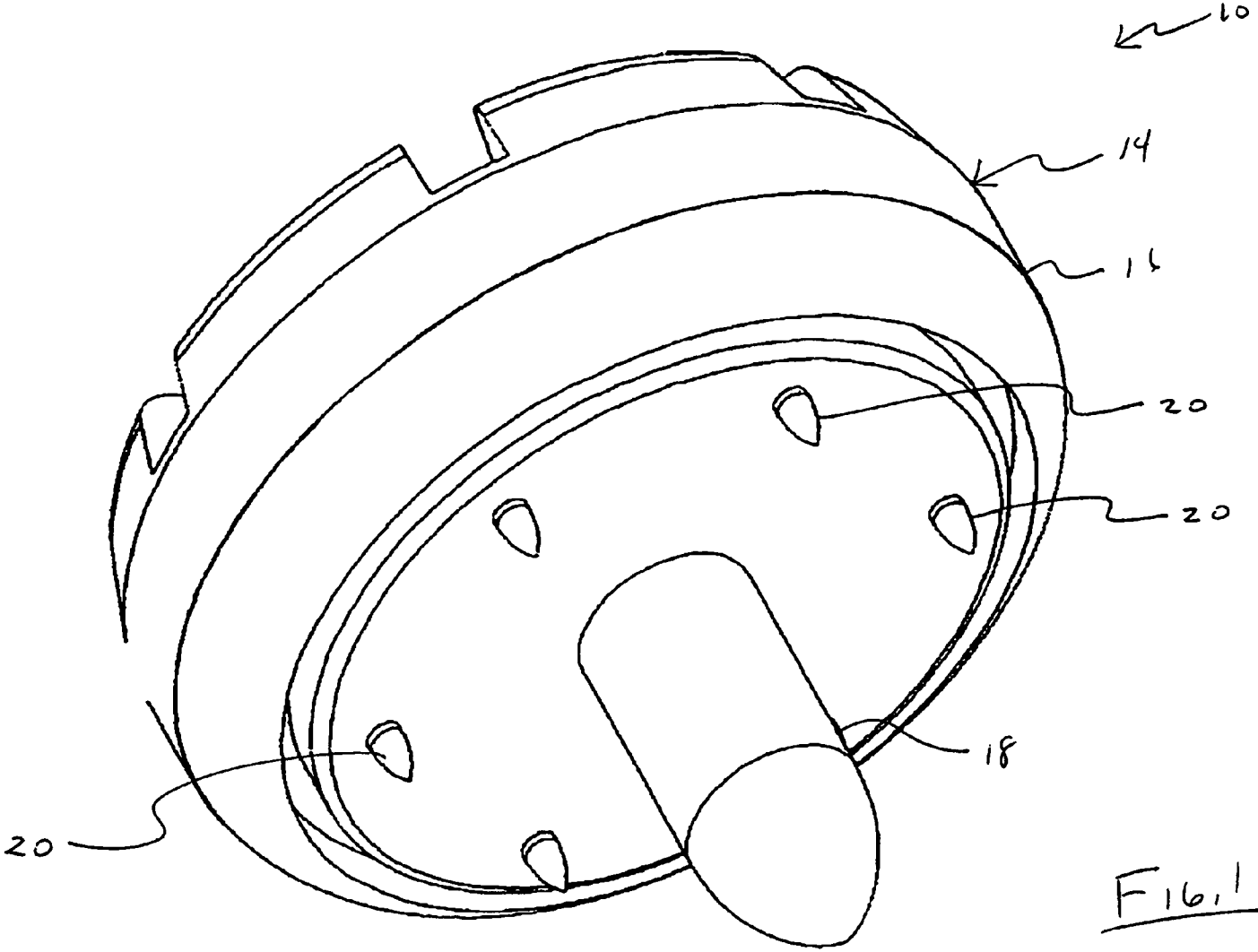
FIG. 1 is a perspective view of a male portion of a snap fastener in accordance with the present invention.
Figure 2:
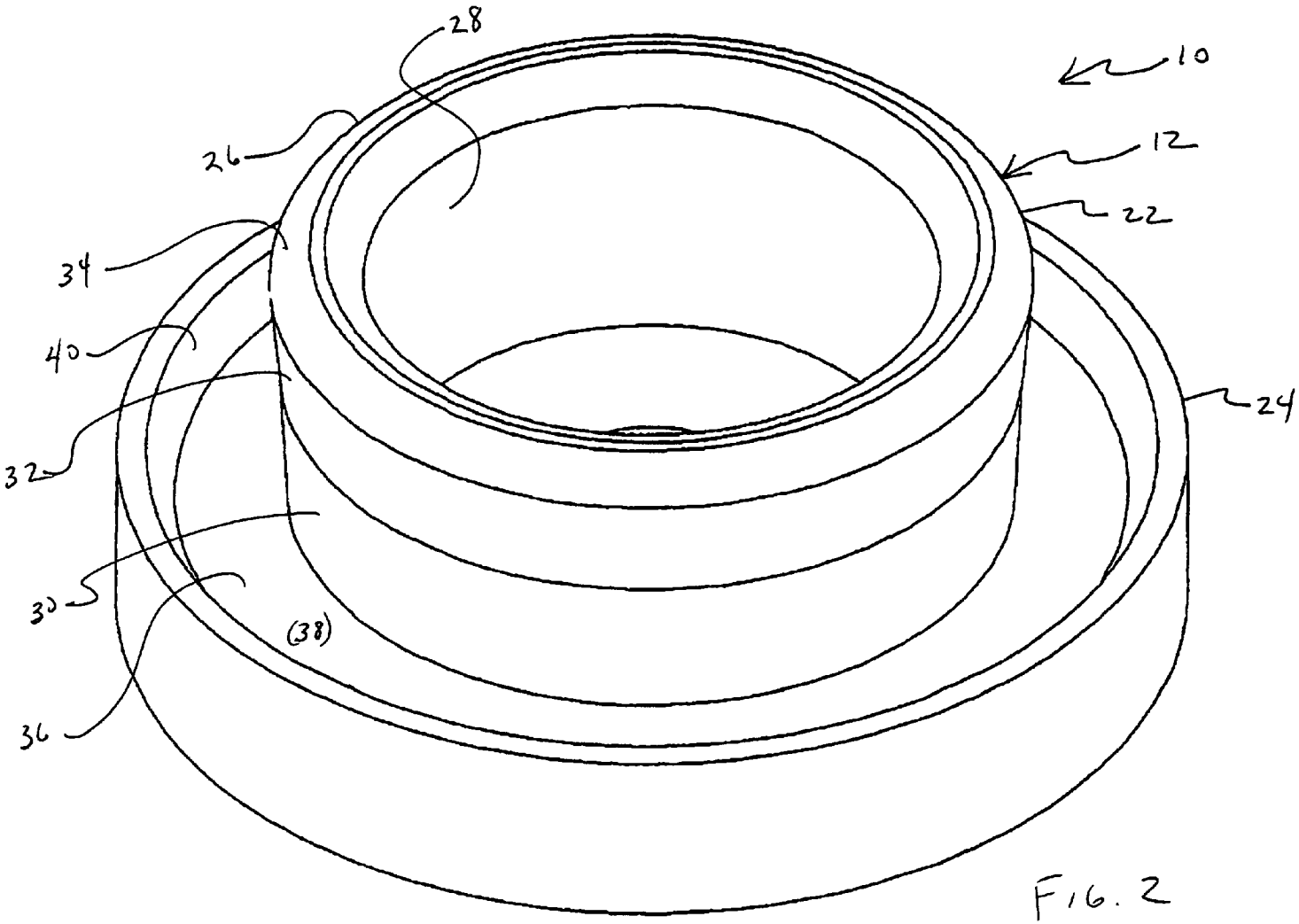
FIG. 2 is a perspective view of a female portion of a snap fastener in accordance with the present invention.

Referring to FIGS. 1 and 2, snap fastener 10 generally includes female portion 12 and male portion 14. Female portion 12 and male portion 14 are formed from a polymer material. For example, female portion 12 and male portion 14 may be formed from holopolymer plastic, such as Delron or another appropriate polymer. Snap fastener 10 may be advantageously formed by injection molding but may be formed by other techniques as well. Snap fastener 10 may be used for fastening on a textile product 15 but may also be used on various other applications such as attaching fabric covers to solid structures.

Snap fastener 10 may be secured to a textile product by a mechanical approach that includes peening. This will be discussed further below. Other securing techniques may be used as well.

Referring to FIG. 1 male portion 14 generally includes cup portion 16, rivet shaft 18 and barbs 20.

Referring to FIG. 2, female portion 12 generally includes stud 22 and plate 24.

Figure 3:
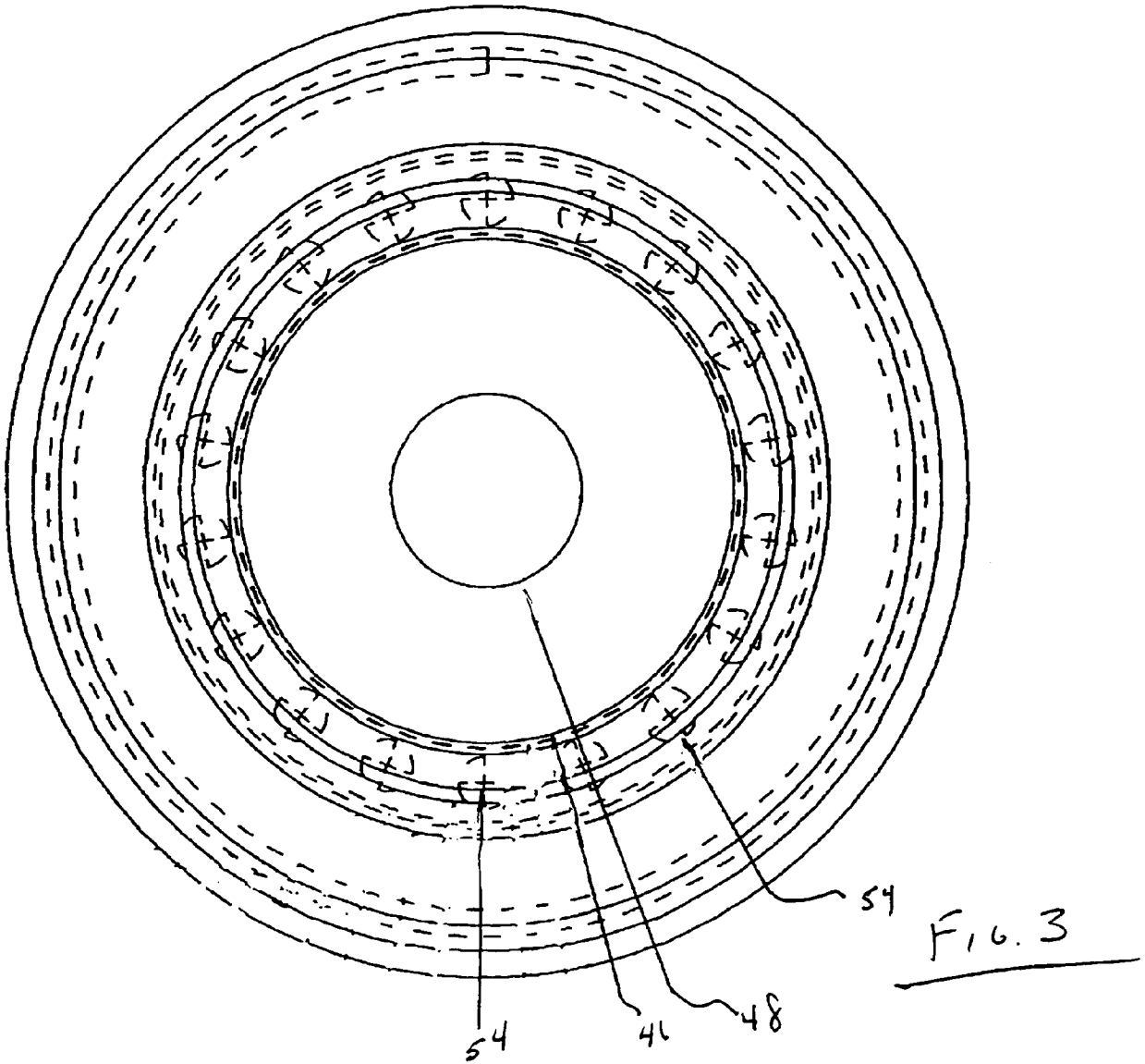
FIG. 3 is a plan view of a female fastener with some structures shown in phantom.
Figure 4:
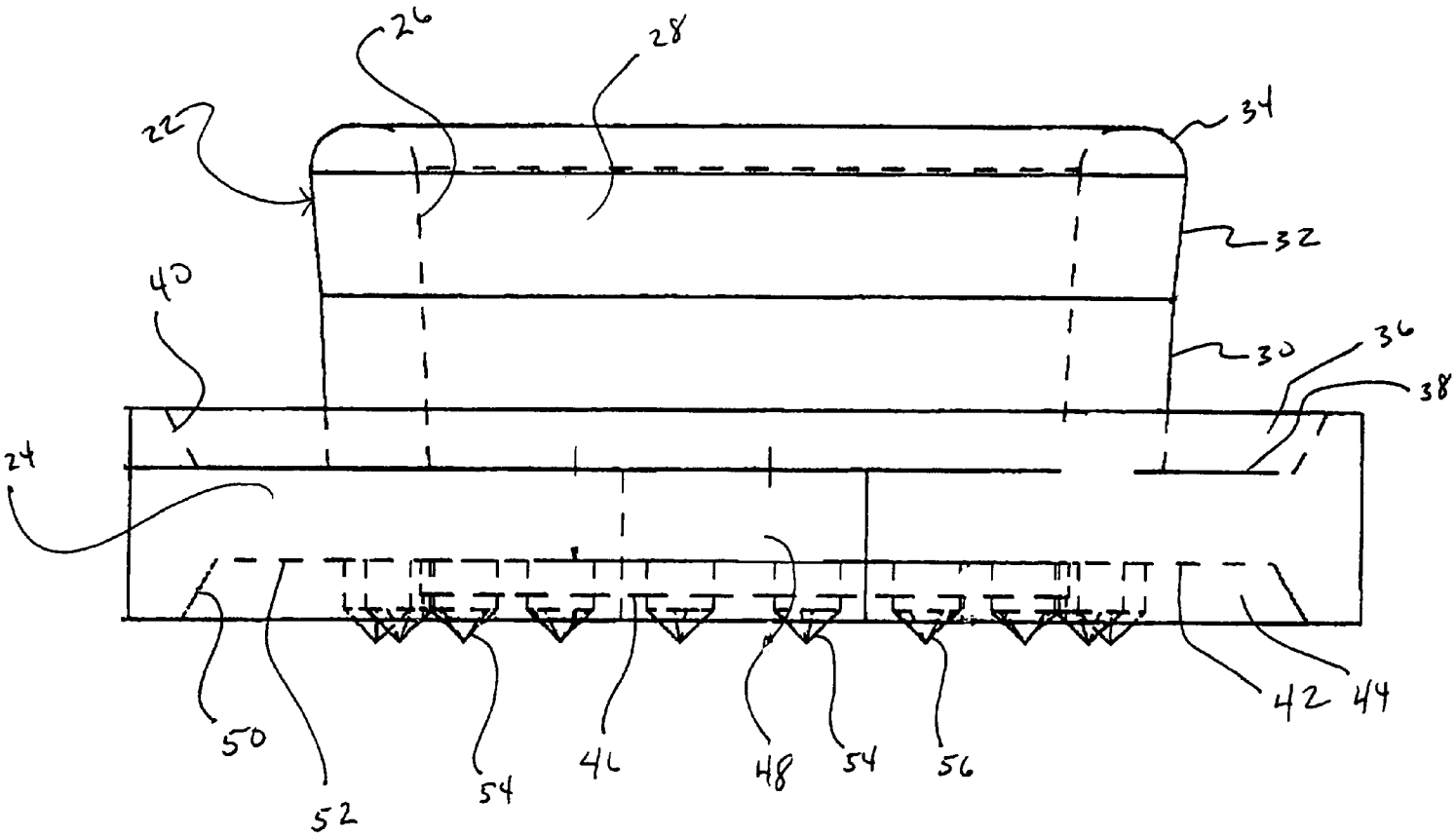
FIG. 4 is an elevational view of the female portion of the snap fastener with some structures shown in phantom.

Referring to FIGS. 2, 3, and 4, stud 22 is a generally cylindrical structure including wall 26 surrounding cavity 28. Wall 26 includes parallel portion 30 and flared portion 32. As best seen in FIGS. 2 and 4, flared portion flares slightly outwardly. Flared portion 32 includes rounded edge 34. Flared portion 32 may form an angle with plate 24 of between eighty five and eighty seven degrees. For example and angle of 85.987 degrees may be used.

Stud 22 together with plate 24 define annular trough 36. Annular trough 36 is bounded by floor 38 and sloped rim 40 of plate 24.

Back surface 42 of female portion 12 is on the opposing side of plate 24 from stud 22. Back surface 42 defines back annular trough 44 and annular plateau 46. Annular plateau 46 surrounds rivet hole 48. Back annular trough 44 is generally bounded by annular plateau 46 sloped rim 50 and back floor 52.

Figure 5:
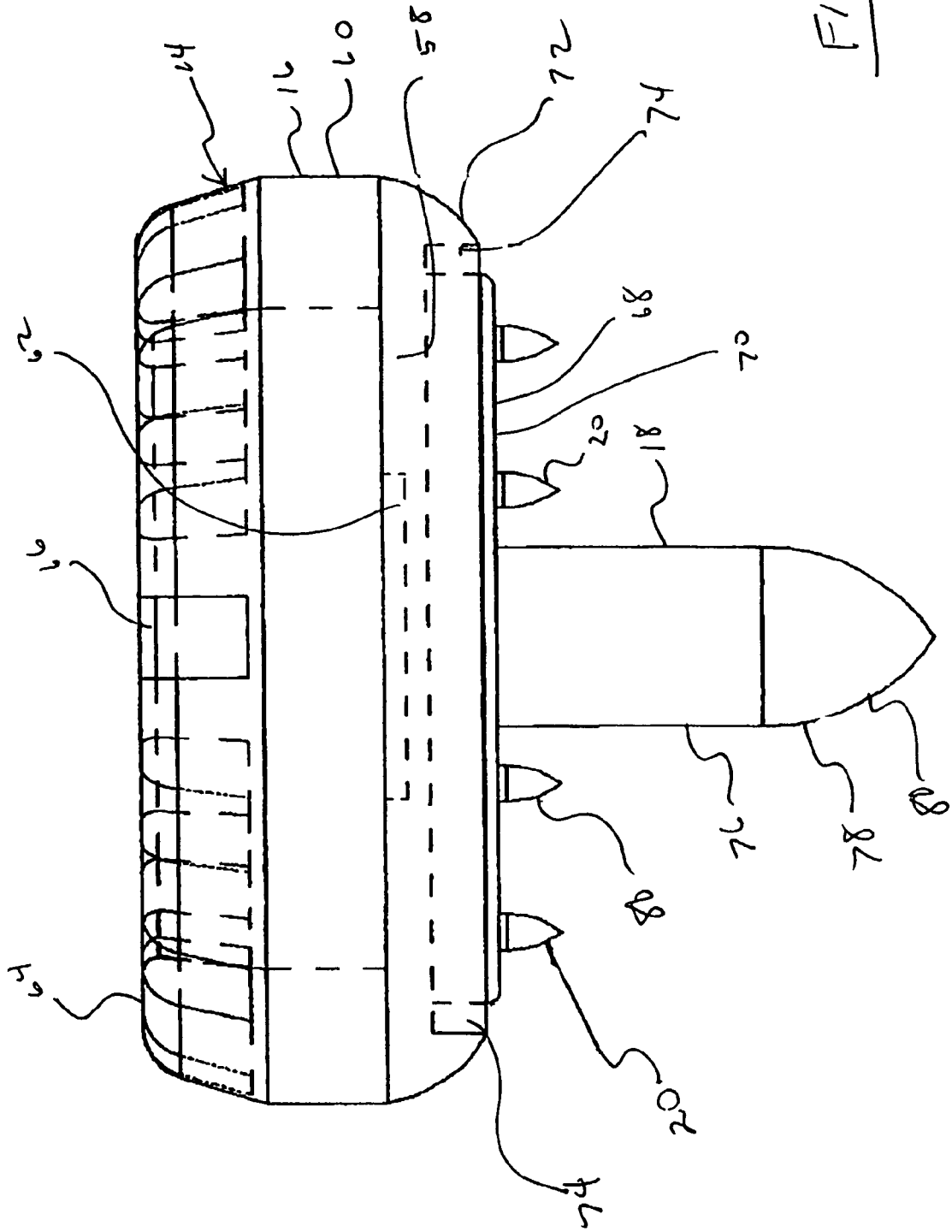
FIG. 5 is an elevational view of the male portion of the snap fastener with some structures shown in phantom.
Figure 6:
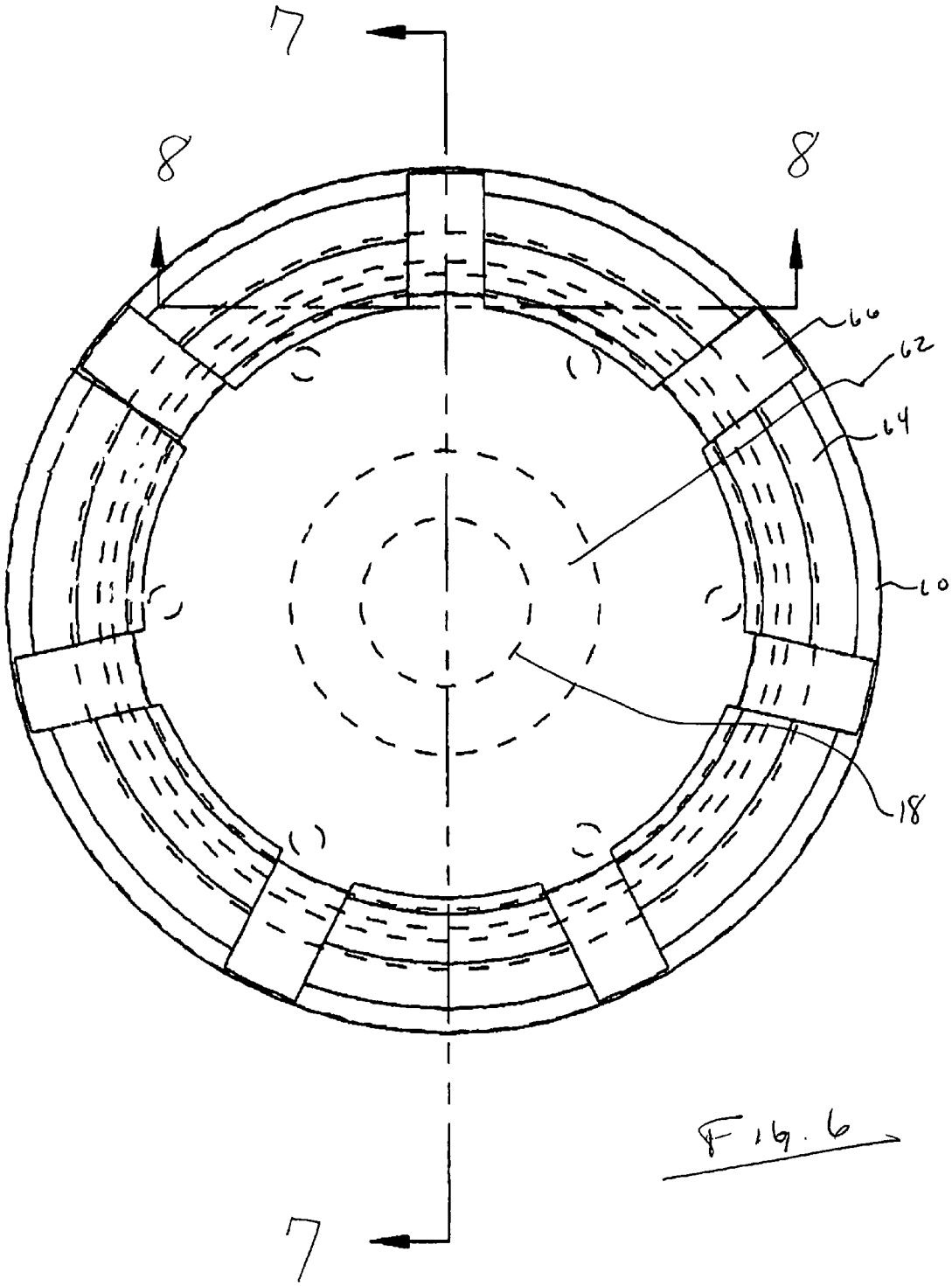
FIG. 6 is a plan view of the male portion of the snap fastener with some structures shown in phantom.

Back surface 42 also presents barbs 54. It is notable that barbs 54 are arranged along a single circle that is concentric with plate 24 and surrounds annular plateau 46. Barbs 54 may include conical point 56 or may include rounded points (not shown) or hemispherical points (not shown). Barbs 54 may be 18 in number. Referring to FIGS. 1, 5, and 6, male portion 14, as discussed above, includes cup portion 16, rivet shaft 18 and barbs 20. It is notable that the number of barbs 54 is a unit multiple of the number of barbs 20.

Figure 7:
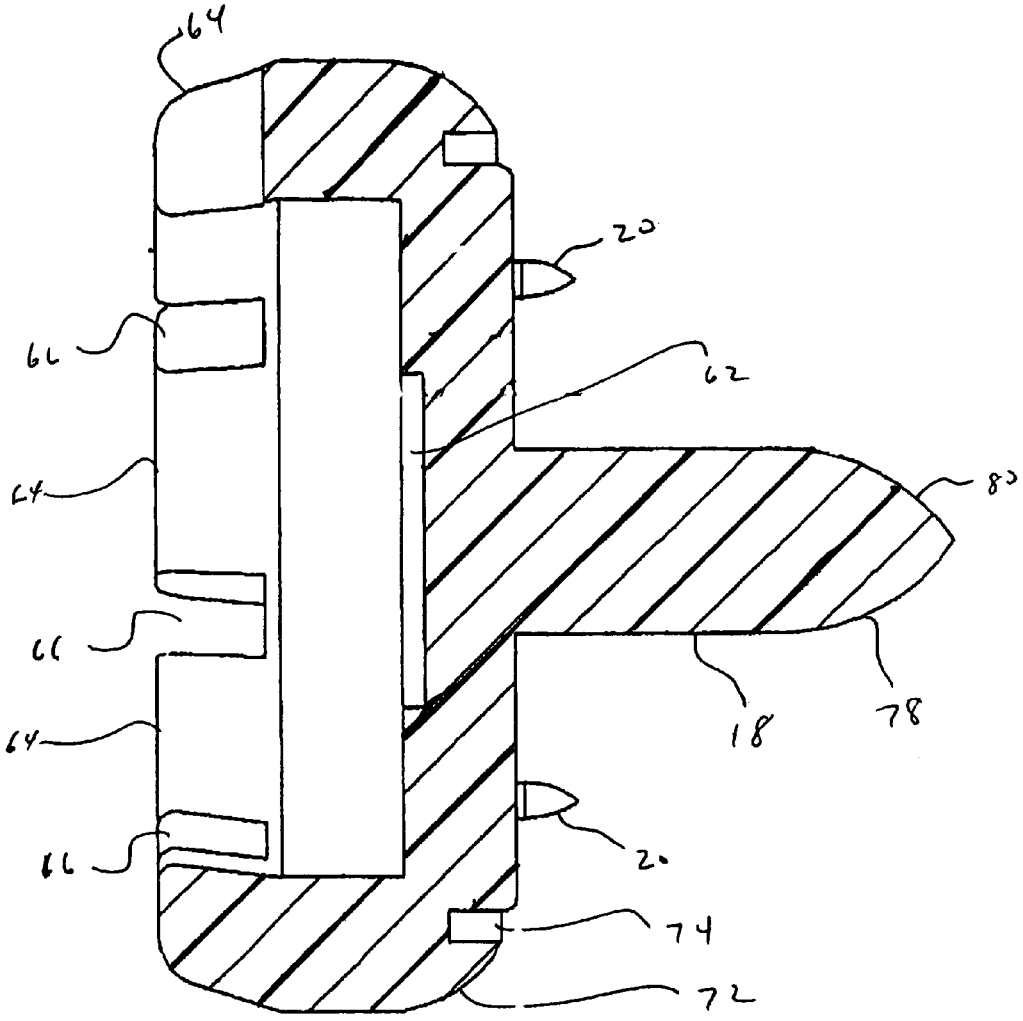
FIG. 7 is a cross-sectional view taken along section line 7-7 of FIG. 6.

Referring to FIGS. 5, 6, and 7, cup portion 16 in generally formed by base 58 and perimeter wall 60. On the inside of cup portion 16, base 58 may define depression 62. Depression 62 may be substantially cylindrical in shape. The diameter of depression 62 is much larger than the altitude of depression 62.

Perimeter wall 60 includes upward extension 64. Extension 64 defines notches 66. Extension 64 extends both upwardly from base 58 and inwardly at an angle.

The interior dimensions of cup portion 16 are such that parallel portion 30 of stud 22 is surrounded and gripped by extensions 64. Flared portion 32 of stud 22 fits within perimeter wall 60. Extension 64 and notches 66 may each number seven.

Back surface 68 of cup portion 16 surrounds rivet shaft 18 and presents barbs 20. Barbs 20 are located in a circle concentric about rivet shaft 18. Notably barbs 20 are in a circle of a diameter slightly different than barbs 54 on female portion 12. Thus, barbs 20 do not interfere with barbs 54 when female portion 12 is assembled to male portion 14 with rivet shaft 18 passing through rivet hole 48. Barbs 20 fall into spaces between barbs 54 and when so located prevent female portion 12 from rotating relative to male portion 14.

Back surface 68 further includes plateau 70 and rounded rim 72. Plateau 70 and rounded rim 72 together define annular groove 74. Annular groove 74 serves to allow flexing of cup portion 16 when stud 22 is inserted into cup portion 16.

Rivet shaft 18 generally includes straight portion 76 and tapered portion 78. Tapered portion 78 may be conical in shape or an ogive 80. Barbs 20 may also include an ogive 80.

Figure 8:
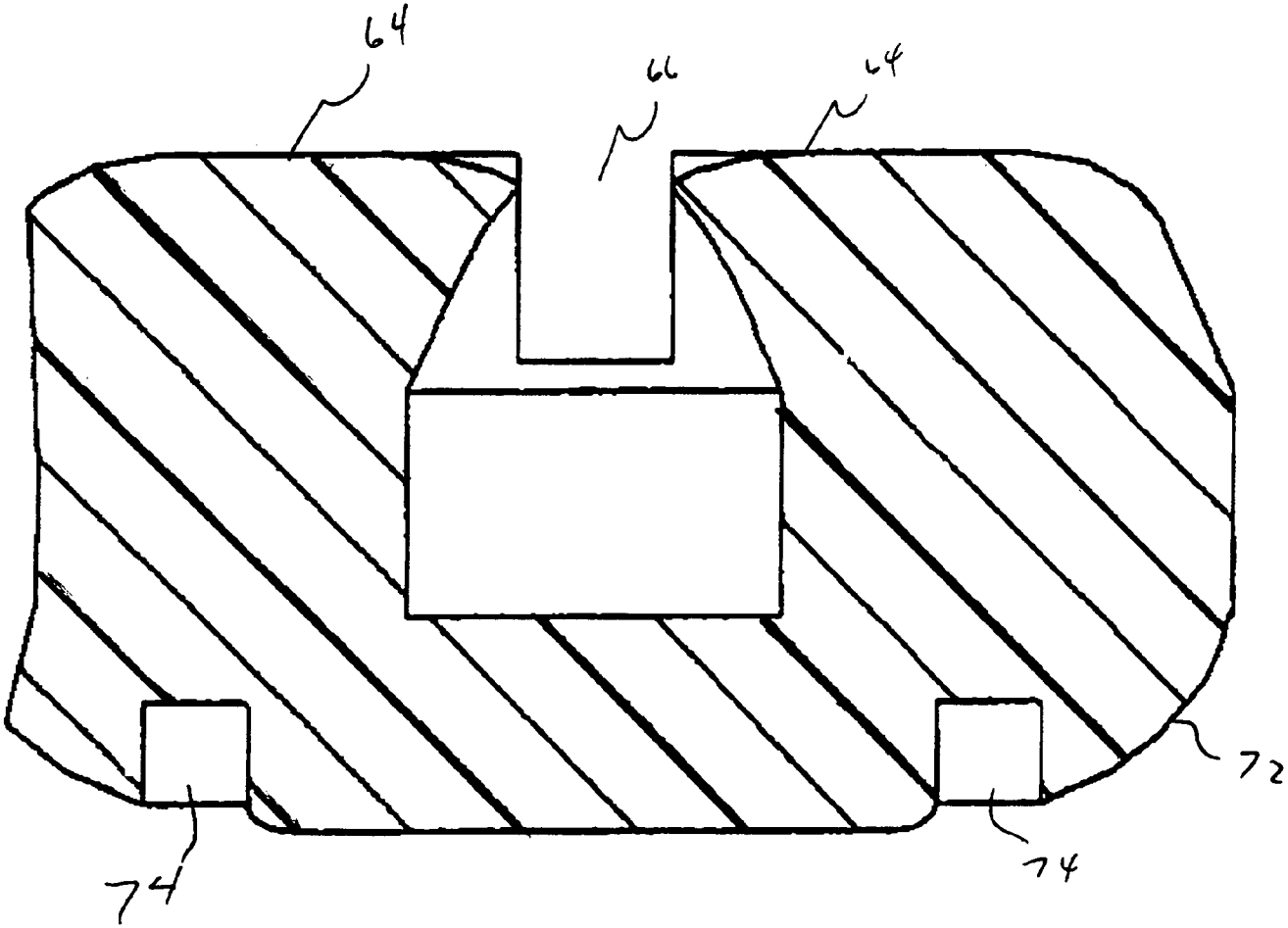
FIG. 8 is a sectional view taken along section line 8-8 of FIG. 6.

Referring to FIG. 8, a sectional view of notches 66 and extension 64 is shown.

Figure 9:
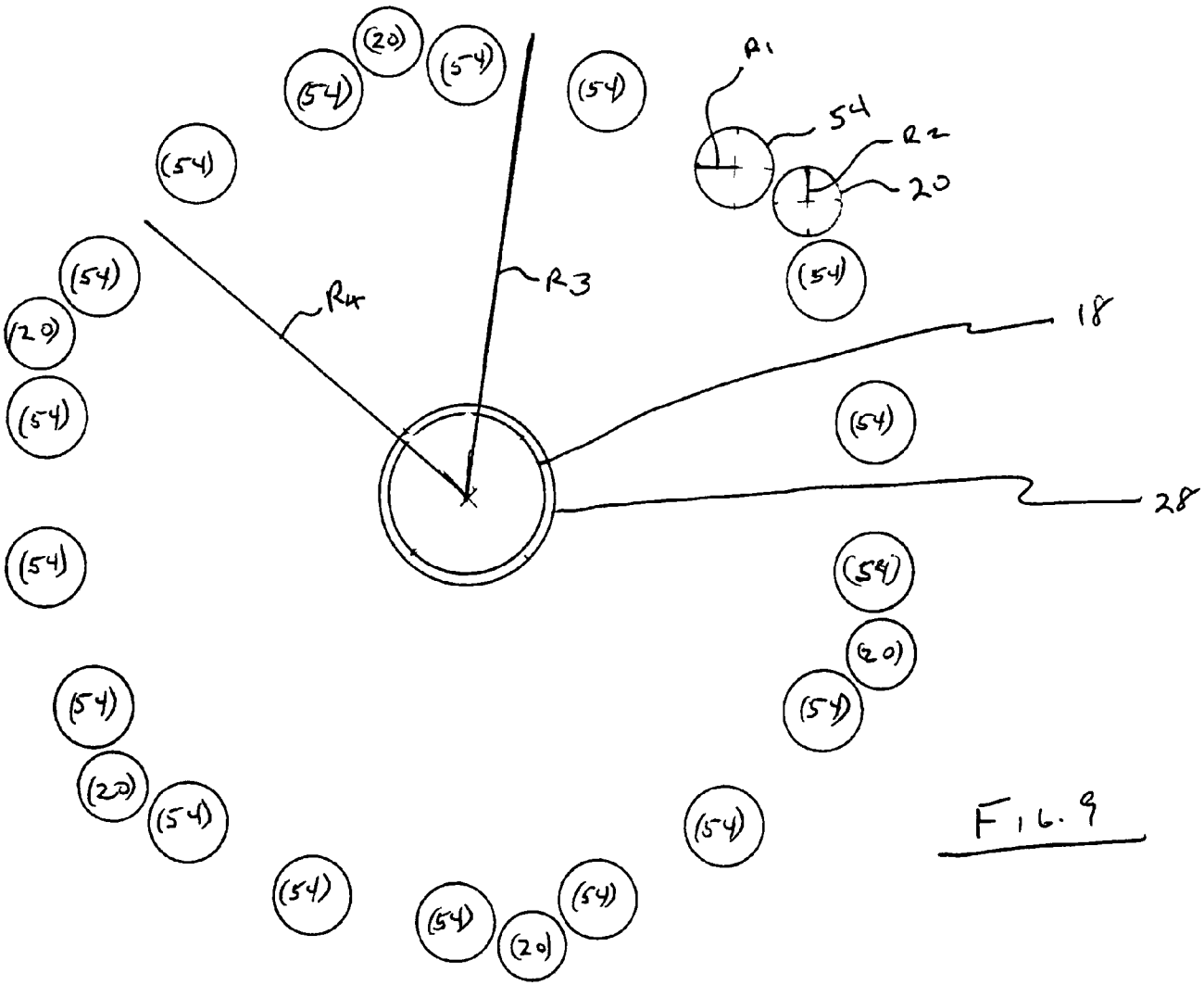
FIG. 9 is a schematic view of how the barbs of a female portion and the barbs of a male portion interlock in accordance with the present invention.
Figure 10:
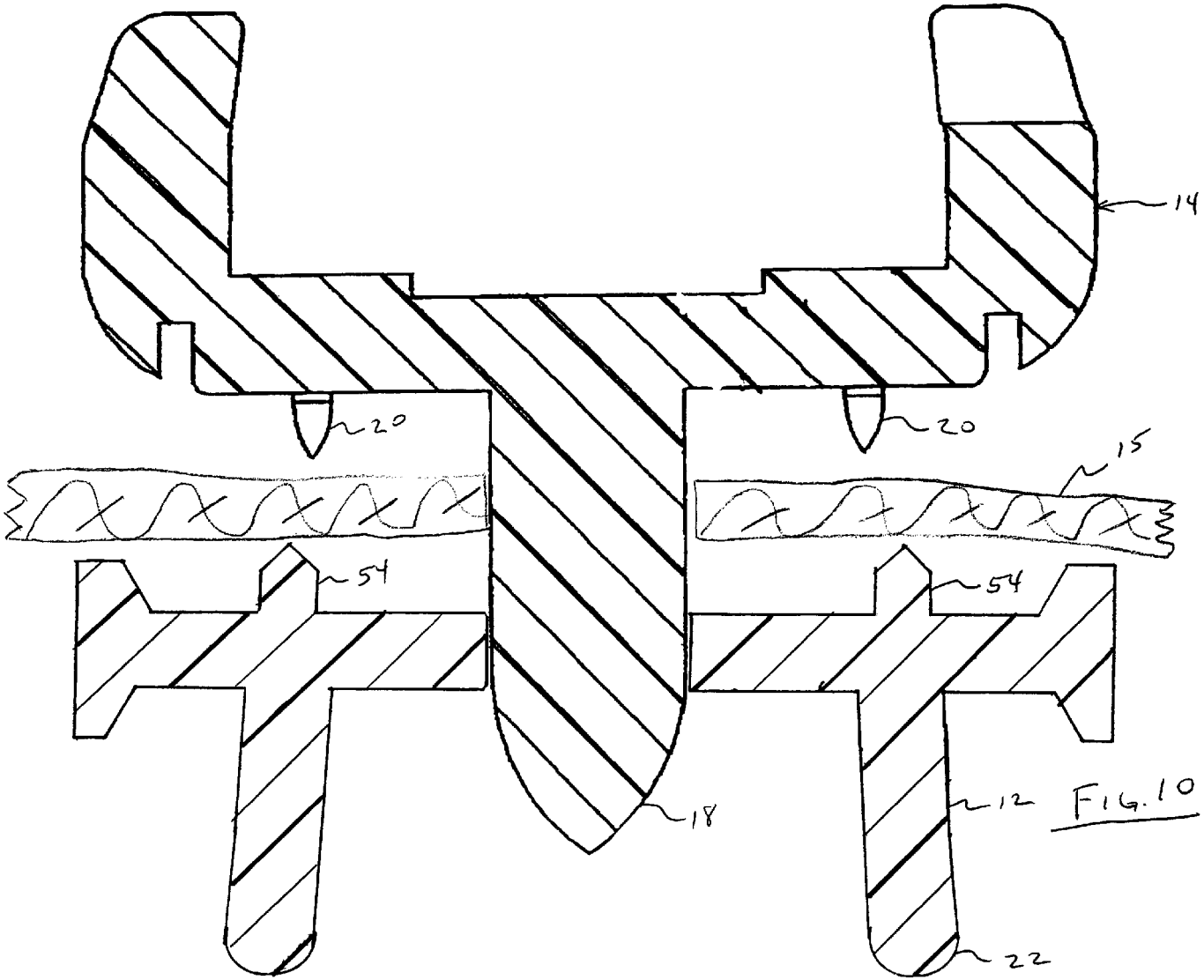
FIG. 10 is a cross sectional view of the male portion and the female portion of a snap fastener partially engaged to a substrate such as fabric.
Figure 11:
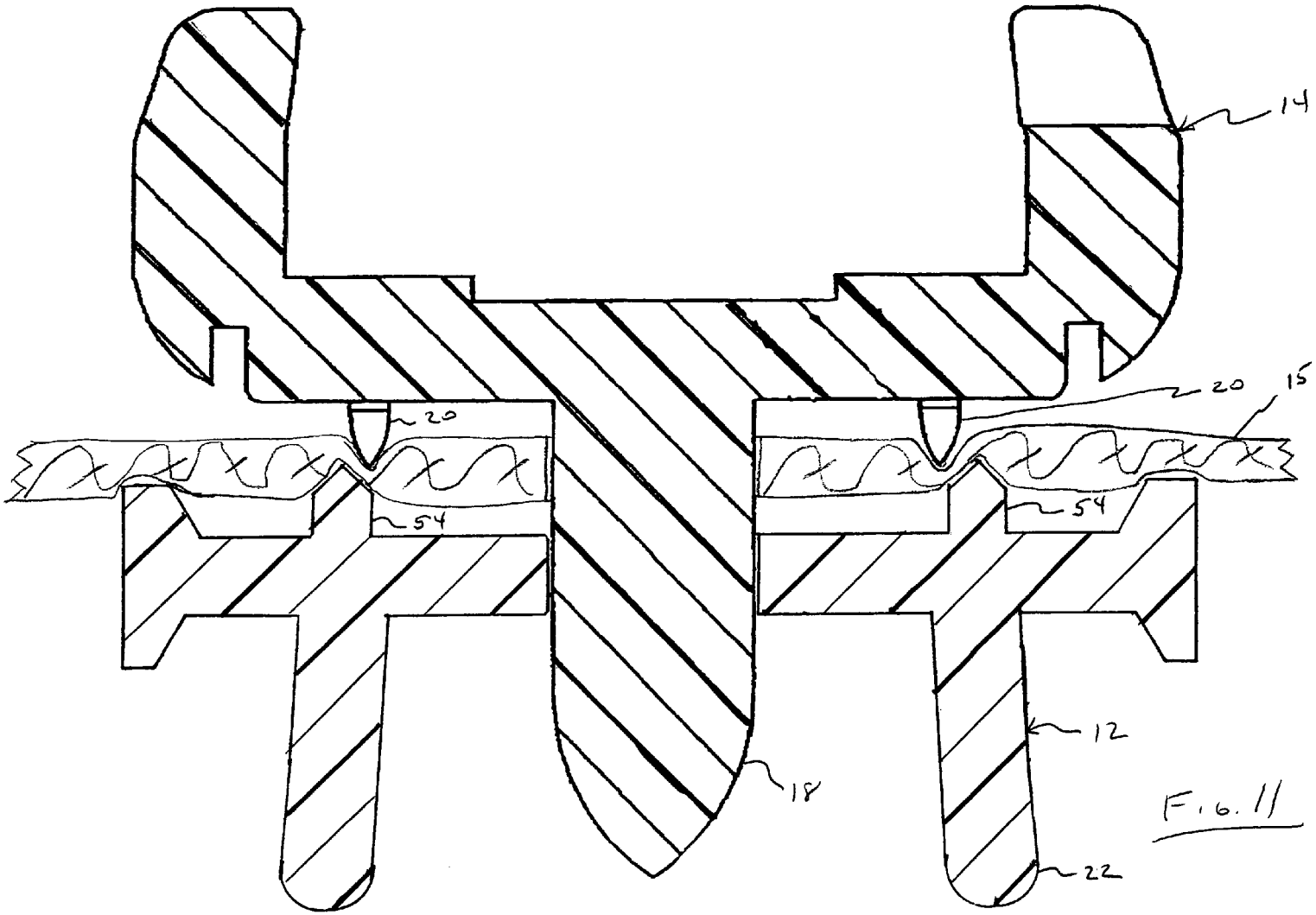
FIG. 11 is a cross sectional view of the male portion and the female portion of a snap fastener substantially fully engaged to a substrate such as fabric.

FIGS. 9-11 depict how barbs 20 are arranged to interlock with barbs 54. Barbs 20 and barbs 54 are arranged on concentric circles of slightly different sizes substantially concentrically located about rivet shaft 18 and rivet hole 28. Barbs 20 are interposed between barbs 54 without interference. Barbs 20 have a radius R1 and barbs 54 have a radius R2. Barbs may also have a perimeter shape that is other than circular in which case R1 and R2 will reflect the radii of circles that enclose the perimeters of barbs 20 and barbs 54 respectively. The inner circle has a radius R3. The outer circle has a radius R4. The absolute value of the difference between radius R3 and radius R4 preferably may be less than about the absolute value of the sum of radii R1 and R2. Written as an equation:

$$|R3-R4| \leq |R1+R2| \qquad \text{Eq. 1}$$

In operation, rivet shaft 18 is forced through fabric or other material and then inserted through rivet hole 48 of female portion 12. Rivet shaft 18 is then peened by pressure applied parallel to the length of rivet shaft 18. Thus, female portion 12 is joined to male portion 14 with textile product 15, fabric or other material in between.

When assembled, barbs 20 are positioned interlocked between barbs 54 thus gripping fabric therebetween and securing female portion 12 and male portion 14 to fabric more securely than prior art plastic snap fasteners.

When it is desired to connect snap fastener 10, female portion 12 is aligned so that stud 22 is aligned with interior of cup portion 16 of male portion 14. Pressure is then applied to female portion 12 and male portion 14 to force stud 22 into cup portion 16. Extensions 64 grip stud 22 thus securing female portion 12 through male portion 14.

When it is desired to separate snap fastener 10 a pulling force is applied to female portion 12 and male portion 14 until female portion 12 separates from male portion 14.

Referring to FIGS. 10 and 11, it can be seen that barbs 20 are positioned interlocked between barbs 54 thus gripping fabric or another substrate therebetween to securely attach snap fastener 10 to textile product 15 or another substrate.

The present invention may be embodied in other specific forms without departing from the spirit of the essential attributes thereof, therefore, the illustrated embodiments should be considered in all respects as illustrative and not restrictive, reference being made to the appended claims rather than to the foregoing description to indicate the scope of the invention.

What is claimed is:

1. A molded polymer snap fastener, comprising:

a male portion having a first mating surface and a rivet shaft extending outwardly away from the mating surface;

a female portion having a second mating surface defining an opening therein, the opening being dimensioned to receive the rivet shaft therein;

one of the male portion or the female portion presenting a cup portion and the other of the male portion or the female portion presenting a stud portion, the stud portion being structured to be snapably receivable in the cup portion wherein the stud portion or the cup portion can be releasably coupled to a second molded polymer snap fastener;

the first mating surface having a plurality of first barbs extending outwardly therefrom, the first barbs each having a first radius R1;

the second mating surface having a plurality of second barbs extending outwardly therefrom, the second barbs having a second radius R2;

the first barbs being arranged along a first substantially circular line substantially concentric with the rivet shaft, the first substantially circular line having a third radius R3;

the second barbs being arranged along a second substantially circular line substantially concentric with the opening, the second substantially circular line having a fourth radius R4; and wherein the third radius R3 is different from the fourth radius R4 and wherein the second barbs and the first barbs are arranged such that each of the second barbs fall into a space between adjacent barbs of the first barbs generally along the first substantially circular line when the male portion and the female portion are mated and the rivet shaft is inserted into the opening.

2. The molded polymer snap fastener as claimed in claim 1, in which the absolute value of the difference between R4 and R3 is less than or about equal to the sum of R1 and R2.

3. The molded polymer snap fastener as claimed in claim 1, wherein a number of the first barbs is a whole number multiple of a number of the second barbs.

4. The molded polymer snap fastener as claimed in claim 1, wherein a number of the second barbs is a whole number multiple of a number of the first barbs.

5. The molded polymer snap fastener as claimed in claim 1, wherein the female portion further comprises a raised ridge at least partially surrounding a perimeter of the second mating surface.

6. The molded polymer snap fastener as claimed in claim 1, wherein at least one of the first barbs and/or at least one of the second barbs comprises a point selected from a group consisting of conical, hemispherical and ogive shaped.

7. A method of making a polymer snap fastener, comprising the steps of:

creating a mold having a cavity that is shaped to form the following structures:

a male portion having a first mating surface and a rivet shaft extending outwardly away from the mating surface;

a female portion having a second mating surface defining an opening therein, the opening being dimensioned to receive the rivet shaft therein;

one of the male portion or the female portion presenting a cup portion and the other of the male portion or the female portion presenting a stud portion, the stud portion being structured to be snapably receivable in the cup portion wherein the stud portion or the cup portion can be releasably coupled to a second molded polymer snap fastener;

the first mating surface having a plurality of first barbs extending outwardly therefrom, the first barbs each having a first radius R1;

the second mating surface having a plurality of second barbs extending outwardly therefrom, the second barbs having a second radius R2;

the first barbs being arranged along a first substantially circular line substantially concentric with the rivet shaft, the first substantially circular line having a third radius R3;

the second barbs being arranged along a second substantially circular line substantially concentric with the opening, the second substantially circular line having a fourth radius R4; and wherein the third radius R3 is different from the fourth radius R4 and wherein the second barbs and the first barbs are arranged such that each of the second barbs fall into a space between adjacent barbs of the first barbs generally along the first substantially circular line when the male portion and the female portion are mated and the rivet shaft is inserted into the opening;

injecting a fluid polymer into the mold cavity;

allowing the fluid polymer to at least partially set; and removing the polymer snap fastener from the mold.

8. The method as claimed in claim 7, further comprising the step of arranging the first barbs and the second barbs such that the absolute value of the difference between R4 and R3 is less than or about equal to the sum of R1 and R2.

9. The method as claimed in claim 7, wherein a number of the first barbs is a whole number multiple of a number of the second barbs.

10. The method as claimed in claim 7, wherein a number of the second barbs is a whole number multiple of a number of the first barbs.

11. The method as claimed in claim 7, wherein the female portion further comprises a raised ridge at least partially surrounding a perimeter of the second mating surface.

12. The method as claimed in claim 7, wherein at least one of the first barbs or at least one of the second barbs comprises a point selected from a group consisting of conical, hemispherical and ogive shaped.

13. A molded polymer snap fastener, comprising:

a male portion having a first mating surface;

a female portion having a second mating surface;

the first mating surface having a plurality of first barbs extending outwardly therefrom, the first barbs each having a first radius R1;

the second mating surface having a plurality of second barbs extending outwardly therefrom, the second barbs having a second radius R2;

the first barbs being arranged along a first substantially circular line, the first substantially circular line having a third radius R3;

the second barbs being arranged along a second substantially circular line, the second substantially circular line having a fourth radius R4; and wherein the third radius R3 is different from the fourth radius R4 and wherein the second barbs and the first barbs are arranged such that the second barbs fall into spaces between the first barbs when the male portion and the female portion are mated and in which the absolute value of the difference between R4 and R3 is less than or about equal to the sum of R1 and R2.

14. The molded polymer snap fastener as claimed in claim 13, the male portion further comprising a rivet shaft extending outwardly away from the mating surface; and the second mating surface defining an opening therein, the opening being dimensioned to receive the rivet shaft therein.

15. The molded polymer snap fastener as claimed in claim 13, wherein a number of the first barbs is a whole number multiple of a number of the second barbs.

16. The molded polymer snap fastener as claimed in claim 13, wherein a number of the second barbs is a whole number multiple of a number of the first barbs.

17. The molded polymer snap fastener as claimed in claim 13, wherein the female portion further comprises a raised ridge at least partially surrounding a perimeter of the second mating surface.

18. The molded polymer snap fastener as claimed in claim 1, wherein at least one of the first barbs or at least one of the second barbs comprises a point selected from a group consisting of conical, hemispherical and ogive shaped.

* * * * *